United States Patent [19]

Beeton et al.

[11] Patent Number: 4,881,991

[45] Date of Patent: Nov. 21, 1989

[54] SPECIAL ROLLED STEELS

[76] Inventors: Thomas B. Beeton, 271 Cilliers Street, Muckleneuk, Pretoria, Transvaal; Roelof J. Mostert, Cormorant Circle 204, Wierda Park, Pretoria, Transvaal, both of South Africa; Emilia B. Navarro; Pierre R. Rosinger, both of 10 Rue Rose, 78990, Elancourt, France; Rudolf P. Badenhorst, 80 van Wouw Street, Groenkloof, Pretoria 0181, Transvaal, South Africa

[21] Appl. No.: 67,614

[22] Filed: Jun. 26, 1987

Related U.S. Application Data

[63] Continuation of Ser. No. 747,040, Jun. 20, 1985, abandoned.

[51] Int. Cl.[4] ..... C22C 38/44

[52] U.S. Cl. ..... 148/325; 420/68; 420/109; 420/70; 420/112

[58] Field of Search ..... 420/68, 69, 70, 109, 420/112; 148/325

[56] References Cited

FOREIGN PATENT DOCUMENTS

| | | | |
|---|---|---|---|
| 0020793 | 1/1981 | European Pat. Off. . | |
| 55-128566 | 10/1980 | Japan | 420/70 |
| 60-221553 | 10/1985 | Japan | 420/70 |
| 508560 | 9/1976 | U.S.S.R. . | |
| 0795471 | 5/1958 | United Kingdom . | |
| 1569701 | 6/1980 | United Kingdom . | |

*Primary Examiner*—Deborah Yee

*Attorney, Agent, or Firm*—Ostrolenk, Faber, Gerb & Soffen

[57] ABSTRACT

A steel for the production of as rolled products (products requiring no subsequent reheat treatment after finish rolling) for use in underground equipment and tools is provided which has a hardness in the order of 500 HV (Vickers); a Charpy toughness value at 20°C. of 35 to 50 Joule; an excellent to fair corrosion resistance in simulated mild mine water as herein defined; and good to fair weldability; the steel having the following constitution on a percentage mass per mass basis:
C=0.13 to 0.19; Cr=8.5 to 12.0;
Ni=0 to 3.0; Si=0.10 to 0.5;
Mn=0.3 to 0.9; Mo=0 to 1.4;
Ti=0.01 to 0.04; Nb=0 to 0.06;
Al=0.02 to 0.06; P=0.035(max); and
S=0.02 (max); the balance being Fe.

16 Claims, 3 Drawing Sheets

HARDNESS - CARBON CONTENT RELATIONSHIP

HARDNESS - CARBON CONTENT RELATIONSHIP

SPECIAL ROLLED STEELS

This application is a continuation of application Ser. No. 06/747040, filed June 20, 1985, now abandoned.

THIS invention relates to special steels, and then, particularly, steels suitable for equipment and tools used underground in the mining industry.

Because of the severe abrasive and corrosive conditions which exist underground in the average mine, and also because of the severe handling conditions to which such equipment and tools are subjected underground, an ideal steel for such equipment and tools would be one which is abrasion, corrosion and impact resistant. Such underground conditions also require that such a steel should preferably also be flame cuttable and easily weldable.

Although it is common knowledge that the surface hardness of a steel, which determines its abrasion resistance, can be increased by increasing the carbon content of the steel, it is equally well known that increased carbon content adversely affects certain of the other properties of such a steel such as, for example, its impact toughness, weldability, etc.

Although such impact toughness can be improved by means of a subsequent heat treatment which is carried out on the as rolled product, this is an expensive procedure which can significantly increase the manufacturing costs of such a steel.

In the rest of this specification the term "as rolled product" will be used to denote a steel product which is obtained when a solidified steel melt, which has been reheated to a temperature in the order of 1200°, is rolled. In other words, it refers to a product which requires no subsequent reheat treatment after finish rolling.

It will be appreciated that such an "as rolled steel product" will be in the untempered or auto-tempered condition.

Furthermore, although it is well known that the corrosion resistance of a steel can generally be improved by increasing its chromium content, it is also known that a high chromium content adversely affects the flame cuttability of such a steel.

In the rest of this specification the corrosion resistance of a steel will be described with respect to the effect which a simulated mildly corrosive mine water has on it, which has the following properties:

| | |
|---|---|
| pH | 7.7 |
| Conductivity at 25° C. | 130 |
| Total dissolved solids (mg/liter) | 910 |
| Suspended solids (mg/liter) | 7 |
| Total alkalinity as $CaCO_3$ | 76 |
| Total hardness as $CaCO_3$ | 374 |
| Calcium hardness as $CaCO_3$ | 320 |
| Magnesium hardness as $CaCO_3$ | 54 |
| Chloride as Cl (mg/liter) | 146 |
| Sulphate as $SO_4$ (mg/liter) | 365 |
| Nitrate as $NO_3$ (mg/liter) | 0.6 |

The term "simulated mild mine water as herein defined" will accordingly in the rest of this specification be used to refer to one with the aforesaid properties.

It has thus far not been possible to provide an as rolled steel which is abrasive, corrosion and impact resistant, and which is also characterised by high impact strength, easy flame cuttability, and good weldability, and which can be made in a relatively inexpensive manner, and it is an object of this invention to provide such a steel and to provide a method for its manufacture.

According to the invention, a steel is provided for the production of as rolled products as herein defined which has substantially the following properties:

a hardness in the order of 500 HV;

a Charpy toughness value at 20° of 35 to 50 Joule; an excellent to fair corrosion resistance in simulated mild mine water as herein defined; and good to fair weldability;

the steel having the following constitution on a percentage mass to mass basis:

C=0.13 to 0.19; Cr=8.5 to 12.0;
Ni=0 to 3.0; Si=0.10 to 0.5;
Mn=0.3 to 0.9; Mo=0 to 1.4;
Ti=0.01 to 0.04; Nb=0 to 0.06;
Al=0.02 to 0.06; P=0.035(max); and
S=0.02 (max); the balance being Fe.

Applicants have found that in such a steel the presence of the Ni, Mo and Nb sufficiently increases the martensitic hardness of the steel so that a hardness in the order of 500 HV is possible even at the stated low carbon level. Furthermore, it was found that the combined effect of the Ni and Mo was sufficient to increase the corrosion resistance to the preferred level stated above even at chromium levels towards the lower end of the stated range.

The relatively low carbon content furthermore ensures good welding properties while good to fair flame cuttability is also obtained at the lower end of the stated ranges.

In a first embodiment of the invention an as rolled steel product of the aforesaid hardness is provided which has a Charpy toughness value at 20° C. of 50 Joule; an excellent corrosion resistance in simulated mild mine water as herein defined, and good weldability, the steel having the same constitution on a percentage mass per mass basis as that set out above, except that C=0.13 to 0.17; Ni=1.5 to 3.0; Cr=10.4 to 12.0; and Mo=0.65 to 1.4.

In a second embodiment of the invention, an as rolled steel product of the aforesaid hardness is provided which has a Charpy toughness value at 20° C. of 50 Joule, a good corrosion resistance in simulated mild mine water as herein defined, and good weldability; the steel having the same constitution as that set out above, except that C=0.13 to 0.17; Cr=8.5 to 10.0; Ni=1.5 to 3.0; and Mo=0.65 to 1.4.

In a third embodiment of the invention, an as rolled steel product of the aforesaid hardness is provided which has a Charpy toughness value at 20° C. of 35 Joule, a fair general corrosion reistance in simulated mild mine water as herein defined, good pit corrosion resistance, and fair weldability; the steel having the same constitution as that set out above, except that C=0.16 to 0.19; Cr=8.5 to 10.0; Ni=0 and Mo=0.65 to 1.4.

In a fourth embodiment of the invention an as rolled steel product of the aforesaid hardness is provided which has a Charpy toughness value at 20° C. of 35 Joule; a fair general corrosion resistance in simulated mild mine water as herein defined, and fair weldability; the steel having the same constitution as that set out above, except that C=0.16 to 0.19; Cr=8.5 to 10.0; Ni=0 and Mo=0.

In a fifth embodiment of the invention, an as rolled steel product of the aforesaid hardness is provided which has a Charpy toughness value at 20° C. of 50 Joule, a good corrosion resistance in simulated mild mine water as herein defined, and good weldability, the steel having the same constitution as that set out above, except that C=0.13 to 0.17; Cr=10.4 to 11.4; Ni=0; and Mo=0.

In a sixth embodiment of the invention, an as rolled steel product of the aforesaid hardness is provided which has a Charpy toughness value at 20° C. of 50 Joule, a relatively good corrosion resistance in simulated mild mine water as herein defined, and good weldability; the steel having the same constitution as that set out above, except that C=0.13 to 0.16; Cr=8.5 to 10; Ni=1.5 to 3.0 and Mo=0.

In a seventh embodiment of the invention, an as rolled steel product of the aforesaid hardness is provided which has a Charpy toughness value at 20° C. of 50 Joule; a good corrosion resistance in simulated mild mine water as herein defined, and good weldability; the steel having the same constitution as that set out above, except that C=0.13 to 0.17; Cr=10.4 to 11.4; Ni=1.5 to 3.0 and Mo=0.

Applicants have furthermore found that by reducing the minimum and maximum specification of the carbon range in any of the aforesaid embodiments by 0.05%, the hardness value of the steel decreased to approximately 400 HV, while the impact properties increased to values larger than 50 Joule at 20° C. At the same time the weldability generally improved, while the corrosion resistance properties were substantially uneffected.

In one example, which will now be described to illustrate the invention in so far as the aforesaid second embodiment is concerned, a production steel melt (160 ton) was prepared which had the following constitution on a percentage mass to mass basis:

C=0.16; Cr=9.0; Si=0.13; Mn=0.7; Ni=2.0; Mo=0.7; Al=0.02; P=0.03; S=0.003; Ti=0.02; Nb=0; the balance being Fe.

Plates with thicknesses ranging from 5 mm to 25 mm were rolled from the steel according to the following controlled rolling schedule: slab reheating temperatures ranged from 1200°-1250° C. The reduction per rolling pass was specified as 15% minimum. Finish rolling temperatures varied with plate thickness.

In spite of the lenient controlled rolling schedules used, a fine as rolled austenite grain size was observed (generally ASTM 8).

After finish rolling, the plates were allowed to air cool. Thinner plates (<8 mm) were run through a cold leveller to improve flatness and plate shearing was performed after cold levelling, but before the plates reached the martensitic hardening temperatures ($M_s \approx 350°$ C.). By using the aforesaid procedure route, it was possible to produce flat plates, sheared to various dimensions, with a good combination of mechanical and corrosion properties (plates thicker than 12 mm were however not sheared, but rather flame cut). Charpy impact values at 20° C. were typically in the order of 50 Joule (5 kgf/cm$^2$), while hardness values ranged from approximately 500 Hv for 8-5 mm plates to 450 Hv for thicker plates.

Figure 1:
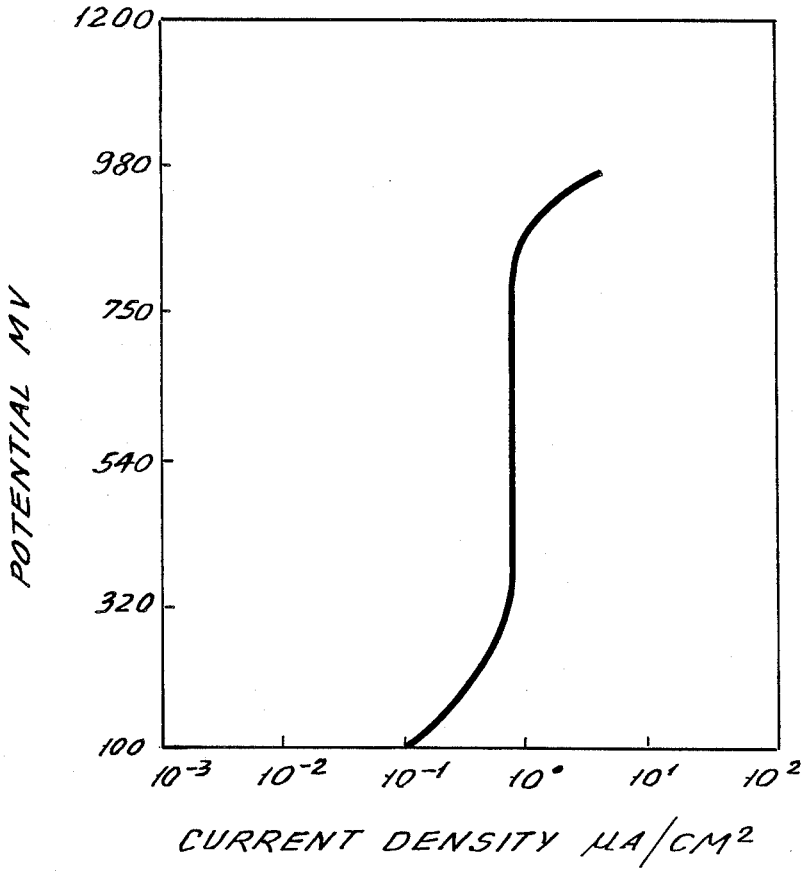
FIG. 1 is a graph showing the typical electrochemical corrosion behaviour of a sample plate of a steel according to the invention.

The typical electrochemical corrosion behaviour in simulted mild mine water as herein defined of samples from such a 6 mm plate, is shown FIG. 1. These results reflect a favourable comparison with the electrochemical behaviour of a commercial 12%Cr steel-3Cr12. The test was run in an aerated medium after sample equilibrium had been reached. The corrosion potential was found to be −130 MV. Although the weldability of martensitic high-chromium steels is often problematic and requires both pre- and post-heating, it was found that plates of this melt could be readily welded without the requirement for either of these heat treatments. This is a major benefit from a practical point of view, because pre- and post-heating in underground mining situations is not generally favoured. This accomplishment was achieved through the careful design of the steel chemistry in such a way that the required hardness (abrasion resistance) could be achieved with the lowest possible carbon content.

Figure 2:
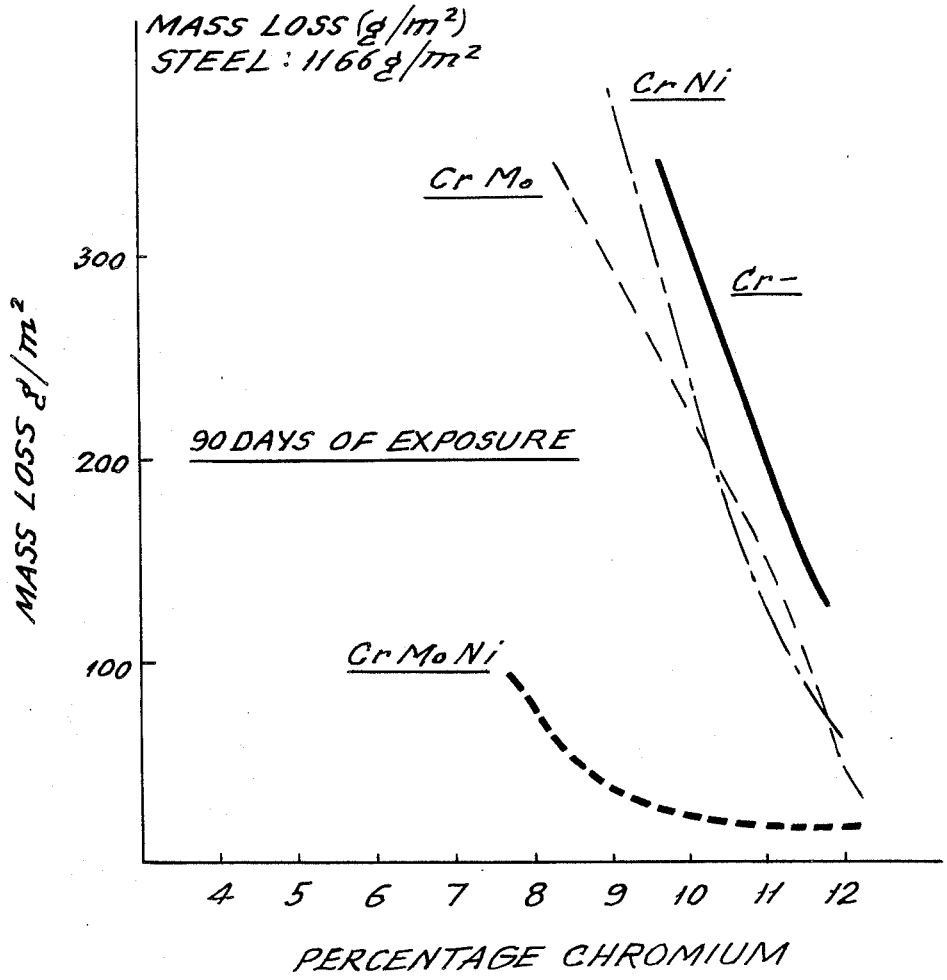
FIG. 2 is a graph showing the effect of various combinations of the elements Cr, Ni and Mo on the behaviour of a steel according to the invention.

The effect of the combined addition of Ni and Mo on the corrosion resistance of the steel is illustrated most dramatically by the graph of FIG. 2, which reflects the results obtained from a Salt Spray Test over 90 days. This graph shows that a 9Cr2Ni 1.40Mo steel exhibits a 10 times smaller mass loss than 9Cr 0.8Mo and a 13 times smaller mass loss than 9 Cr3Ni steel respectively.

Also, potentiodynamic studies in simulated mildly corrosive mine waters as herein defined showed that a 9Cr 0.8Mo alloy exhibited a fairly high passivation current density, while a 8.7Cr2Ni 1.4Mo showed much improved passivation behaviour, while that of a 12Cr2Ni 0.7 Mo steel was even better.

Pitting resistance tests also showed the beneficial influence of Mo and combined Ni and Mo additions on the steel.

Figure 3:
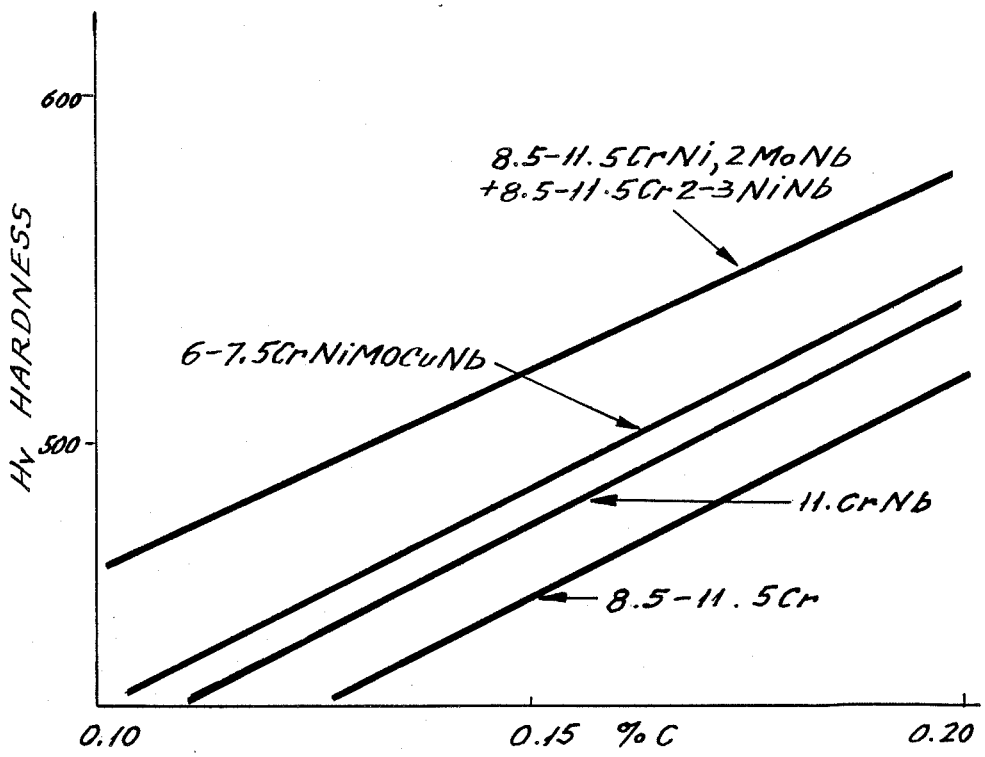
FIG. 3 is a graph showing the interrelationship between the hardness and carbon content of a plurality of different steels according to the invention.

The interrelationship between hardness and carbon content for the steels according to the invention is reflected by the graphs of FIG. 3 which are based on experimental results. These graphs may be consulted for determining the preferred carbon content of a particular steel in order to give a product of predetermined hardness.

From the graphs of FIG. 3, the effect of the Ni, Mo and Nb additives on the hardness (abrasion resistance) of the steel for the same carbon content can be predetermined. Thus, it will be noted that the hardness of a 8.5 to 11.5Cr 2Ni 1.2Mo Nb steel (or that of a +8.5 to 11.5Cr 2 to 3NiNb) steel is substantially (plus minus 60 HV) higher than that of a simple 8.5-11.5Cr alloy.

This means that the same high hardness levels are possible with a CrNiMoNb steel with considerably lower (plus minus 0.06%) carbon content than what the case is with a plain Cr steel. Thus, for example, a 500 HV hardness level can be obtained with a carbon content of only 0.14% in such a CrNiMoNb steel, while a carbon content of plus minus 0.19% is required to achieve the same hardness with a plain Cr steel.

Since low carbon content in a steel also results in improved impact properties, the method according to the invention also makes the achievement of high Charpy values in the untempered steel possible.

However, since it is essential for a steel with good impact toughness that a fine as rolled structure be produced, applicant has developed a method for the controlled rolling of the steel by means of which a prior austenite grain size in the order of 8–10 ASTM can be obtained.

According to this aspect of the invention, a method of rolling a steel includes the steps of reheating the steel to a temperature on the order of 1150° C.; deforming the steel during each rolling pass by at least 20%, except for the first and last passes when the deformation may be in the order of 15%; and maintaining a finish rolling temperature in the order of 950° C. after effecting a total reduction on the order of 90%.

Further according to this aspect of the invention, the method includes the step of quenching the steel immediately after the aforesaid rolling schedule; continuing with the quenching until a temperature has been reached where plus minus 80% of the austenite has been transformed to martensite; and thereafter allowing the steel to air cool.

Applicants have found that the structure produced by such treatment is a fine autotempered martensite with excellent impact properties.

Applicant have furthermore found that the microalloying elements Ti and Nb in the steel are effective in controlling the as rolled grain size by inhibiting grain growth during reheating and by retarding recrystallisation during and after rolling. It is furthermore believed that the presence of the Al in the steel is benificial with regard to impact properties through a grain refining action and also because of its binding of the detrimental elements N and O in the form of stable nitrides and oxides.

Although the normal steelmaking route may be employed in the manufacture of a steel according to the invention, the use of desulphurisation and vacuum arc degassing is recommended because of the low S, N and O levels which may be so obtained.

To summarise, the main novel features of the steel compositions according to the invention are the combination of the following properties: good weldability, abrasion resistance, corrosion resistance, impact toughness, flame cuttability and an inexpensive process route which requires no secondary heat treatments or stringent controlled rolling procedures. Although some existing steel types may have some of the required attributes, the steel types herein embodied achieve the required properties simultaneously and provide an unique combination of these properties. The specific properties which are achieved are as follows:

Abrasion resistance:

It was found that a high level of hardness and good abrasion resistance could be achieved at surprisingly low carbon contents by making discerning use of the alloying elements Cr, Ni, Mo and Nb, as illustrated in FIG. 3, and thus eliminating the requirement for subsequent tempering treatments. It will be appreciated that such tempering heat treatments which are generally required for the improvement of impact toughness, are inadvertently coupled to a reduction in hardness, which is usually compensated for by using fairly high carbon levels. High carbon levels on the other hand result in poor weldability, impact properties and corrosion resistance.

By careful alloy design, the untempered impact properties of the claimed steel types were improved to such an extent that tempering could be eliminated, thus facilitating the achievement of high hardness at low carbon content. The relatively low carbon content of the steels have major benefits as a result, as will be indicated below.

Weldability:

With conventional high chromium martensitic steel grades, both preheating and postheating are required when welding.

This requirement constitutes a major disadvantage from a practical point of view, as the mentioned heat treatments are difficult to apply and control in underground situations. The relatively low carbon content of the steels according to the invention means that neither preheating nor postheating are required for such welding procedures. This fact constitutes a major advantage over existing steels.

Impact properties:

Conventional high-chromium martensitic grade steels are generally characterised by poor impact toughness in the fully hardened condition. By achieving a low carbon content and making use of combinations of elements such as Ni and Mo, this problem was overcome in steels of the present invention.

Flame cuttability:

For some mining applicaions, it is required from the steel type that it should be flame cuttable to such an extent that rough cuts can be made for maintenance purposes. Applicants' investigations revealed that 12 mm plates with chromium contents smaller than approximately 9% achieved this requirement, while steel types with higher chromium contents did not achieve this property. It was also found that, generally, the steel types with less than 9%Cr exhibited poor corrosion properties. By alloy design and testing of approximately 70 alloys, it was found that the corrosion properties of 9%Cr steels could be signifcantly improved through use of alloying elements such as Ni and Mo (see FIG. 2). Consequently, it was possible to design steel types which were simultaneously flame cuttable, weldable and corrosion resistance.

Corrosion properties:

As previously stated, it was found that the combination of the alloying element Cr, Ni and Mo resulted in remarkable corrosion resistance, and fairly low chromium contents. The use of low carbon levels is furthermore believed to have a strong influence on improving stress corrosion cracking susceptibility.

Inexpensive process route:

To facilitate cost savings, it was aimed to develop an inexpensive process route which would give rise to a steel having all the above properties. Conventionally high Cr martensitic plates are rolled, cooled, reheated, quenched and tempered. Through carefull alloy design the steels of the present invention need only be controlled rolled and none of the conventional reheat treatments are required. Generally, high heat temperatures up to 1250° C. and fairly relaxed rolling schedules (minimum 15% reduction per pass) can be used. After controlled rolling, thinner plates are allowed to air cool before being put through a cold leveller. Following cold levelling, these plates can be sheared at temperatures above those at which martensitic hardening occurs (300°–350° C).

All the aforesaid steps contribute to the fact that a fairly inexpensive process route is possible which gives a product with a good combination of the aforesaid properties.

It will hence be appreciated that only through a combination of all the novel features discussed above, was it possible to develop inexpensive steel types which achieve the combination of the aforesaid required properties.

It will be appreciated further that the invention provides a novel steel (and a method for its manufacture) with properties which are ideally suited for equipment and tools intended for underground use in mines.

It will be appreciated still further that there are no doubt many variations in detail possible with a steel and its method of manufacture which do not fall outside the scope of the appended claims.

We claim:

1. A rolled steel product as herein defined which has substantially the following properties:

a hardness in the order of 500 HV (Vickers); a Charpy toughness value at 20° of 35 to 50 Joule; an excellent to fair corrosion resistance in simulated mild mine water as herein defined; and good to fair weldability; the steel having the following constitution on a percentage mass to mass basis:

C=0.13 to 0.19; Cr=8.5 to 12.0;
Ni=0 to 3.0; Si=0.10 to 0.5;
Mn=0.3 to 0.9; Mo=0 to 1.4;
Ti=0.01 to 0.04; Nb=0 to 0.06;
Al=0.02 to 0.06; P=0.035(max); and
S=0.02 (max); the balance being Fe.

2. The rolled steel of claim 1, characterised in that its C, Cr, Ni and Mo content on a percentage mass per mass basis is C=0.13 to 0.17; Cr=10.4 to 12.0; Ni=1.5 to 3.0 and Mo=0.65 to 1.4; that is Charpy toughness value at 20° C. is 50 Joule, and that it has an excellent corrosion resistance in simulated mild mine water as herein defined, and good weldability.

3. The rolled steel of claim 1, characterised in that its C, Cr, Ni and Mo content on a percentage mass per basis is C=0.13 to 0.17; Cr=8.5 to 10.0; Ni=1.5 to 3.0; and Mo=0.65 to 1.4; that its Charpy toughness value at 20° C. is 50 Joule and that it has a good corrosion resistance in simulated mild mine water as herein defined, and good weldability.

4. The rolled steel of claim 1, characterised in that its C, Cr, Ni and Mo content on a percentage mass per mass basis is C=0.16 to 0.19; Cr=8.5 to 10.0; Ni=0 and Mo=0.65 to 1.4, that its Charpy toughness value at 20° C. is 35 Joule, and that it has a fair general corrosion resistance in simulated mild mine water as herein defined, good pit corrosion resistance, and fair weldability.

5. The rolled steel of claim 1, characterised in that its C, Cr, Ni and Mo content on a percentage mass per mass basis is C=0.16 to 0.19; Cr=8.5 to 10.0; Ni=0 and Mo=0; that its Charpy toughness value at 20° C. is 35 Joule and that it has fair general corrosion resistance in simulated mild mine water as herein defined, and fair weldability.

6. The rolled steel of claim 1, characterised in that its C, Cr, Ni and Mo content on a percentage mass per mass basis is C=0.13 to 0.17; Cr=10.4 to 11.4; Ni=0; Mo=0; that its Charpy toughness value at 20° C. is 50 Joule, and that it has good corrosion resistance in simulated mild mine water as herein defined, and good weldability.

7. The rolled steel of claim 1, characterised in that its C, Cr, Ni and Mo content on a percentage mass per mass basis is C=0.13 to 0.16; Cr=8.5 to 10.0; Ni=1.5 to 3.0 and Mo=0; that its Charpy toughness value at 20° C. is 50 Joule, and that it has relatively good corrosion resistance in simulated mild mine water as herein defined, and good weldability.

8. The rolled steel of claim 1, characterised in that its C, Cr, Ni and Mo content on a percentage mass per mass basis is C=0.13 to 0.17; Cr=10.4 to 11.4; Ni=1.5 to 3.0 and Mo=0; that its Charpy toughness value at 20° C. is 50 Joule and that it has good corrosion resistance in simulated mild mine water as herein defined, and that it has good weldability.

9. A rolled steel product which has substantially the following properties:

a hardness in the order of approximately 400 HV to 500 HV (Vickers); a Charpy toughness value at 20° of at least 35 Joule; an excellent to fair corrosion resistance in simulated mild mine water as herein defined; and good to fair weldability; the steel having the following constitution on a percentage mass to mass basis:

C=0.08 to 0.19; Cr=8.5 to 12.0;
Ni=0 to 3.0; Si=0.10 to 0.5;
Mn=0.3 to 0.9; Mo=0 to 1.4;
Ti=0.01 to 0.04; Nb=0 to 0.06;
Al=0.02 to 0.06; P=0.035 (max); and
S=0.02 (max); the balance being Fe.

10. The rolled steel product of claim 9 characterized in that its C, Cr, Ni and Mo content on a percentage mass per mass basis is C=0.08 to 0.17; Cr=10.4 to 12.0; Ni=1.5 to 3.0 and Mo=0.65 to 1.4; that its Charpy toughness value at 20° C. is at least 50 Joule, and that it has an excellent corrosion resistance in simulated mild mine water as herein defined, and good weldability.

11. The rolled steel product of claim 9, characterized in that its C, Cr, Ni and Mo content on a percentage mass per basis is C=0.08 to 0.17; Cr=8.5 to 10.0; Ni=1.5 to 3.0; and Mo=0.65 to 1.4; that its Charpy toughness value at 20° C. is at least 50 Joule and that it has a good corrosion resistance in simulated mild mine water as herein defined, and good weldability.

12. The rolled steel product of claim 9, characterized in that its C, Cr, Ni and Mo content on a percentage mass per mass basis is C=0.11 to 0.19; Cr=8.5 to 10.0; Ni=0 and Mo=0.65 to 1.4, that its Charpy toughness value at 20° C. is at least 35 Joule, and that it has a fair general corrosion resistance in simulated mild mine water as herein defined, good pit corrosion resistance, and fair weldability.

13. The rolled steel product of claim 9, characterized in that its C, Cr, Ni and Mo content on a percentage mass per mass basis is C=0.11 to 0.19; Cr=8.5 to 10.0; Ni=0 and Mo=0; that its Charpy toughness value at 20° C. is at least 35 Joule and that it has fair general corrosion resistance in simulated mild mine water as herein defined, and fair weldability.

14. The rolled steel product of claim 9, characterized in that its C, Cr, Ni and Mo content on a percentage mass per mass basis is C=0.08 to 0.17; Cr=10.4 to 11.4; Ni=0; Mo=0; that its Charpy toughness value at 20° C. is at least 50 Joule, and that it has good corrosion resistance in simulated mild mine water as herein defined, and good weldability.

15. The rolled steel product of claim 9, characterized in that its C, Cr, Ni and Mo content on a percentage mass per mass basis is C=0.08 to 0.16; Cr=8.5 to 10.0; Ni=1.5 to 3.0 and Mo=0; that its Charpy toughness value at 20° C. is at least 50 Joule, and that it has relatively good corrosion resistance in simulated mild mine water as herein defined, and good weldability.

16. The rolled steel product of claim 9, characterized in that its C, Cr, Ni and Mo content on a percentage mass per mass basis is C=0.08 to 0.17; Cr=10.4 to 11.4; Ni=1.5 to 3.0 and Mo=0; that is Charpy toughness value at 20° C. is at least 50 Joule and that it has good corrosion resistance in simulated mild mine water as herein defined, and that it has good weldability.

* * * * *